US006345968B1

(12) United States Patent
Shupe

(10) Patent No.: US 6,345,968 B1
(45) Date of Patent: Feb. 12, 2002

(54) HYDRAULIC MOTOR WITH BRAKE ASSEMBLY

(75) Inventor: Brad P. Shupe, Greeneville, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/568,636

(22) Filed: May 10, 2000

Related U.S. Application Data

(60) Provisional application No. 60/134,986, filed on May 20, 1999.

(51) Int. Cl.[7] ..... F03C 2/00

(52) U.S. Cl. ..... 418/61.3; 418/104; 418/170

(58) Field of Search ..... 418/61.3, 104; 188/170

(56) References Cited

U.S. PATENT DOCUMENTS

| | | | | |
|---|---|---|---|---|
| 3,071,210 A | | 1/1963 | Wrigley et al. | |
| 3,441,110 A | | 4/1969 | Ruggen | |
| 3,536,230 A | | 10/1970 | Williams et al. | |
| 3,616,882 A | | 11/1971 | White et al. | |
| 3,680,666 A | * | 8/1972 | Sommer | 188/170 |
| 3,688,878 A | | 9/1972 | Barmasse | |
| 3,946,837 A | * | 3/1976 | Houser | 188/170 |
| 3,960,470 A | | 6/1976 | Kinder | |
| 4,184,573 A | * | 1/1980 | Bricker et al. | 188/170 |
| 4,739,865 A | | 4/1988 | Yater et al. | |
| 4,930,312 A | | 6/1990 | Metcalf | |
| 4,981,423 A | | 1/1991 | Bissonnette | |
| 5,114,324 A | | 5/1992 | Spindeldreher | |
| 5,333,705 A | | 8/1994 | Lemaire et al. | |
| 5,390,495 A | | 2/1995 | Lemaire | |

FOREIGN PATENT DOCUMENTS

| | | |
|---|---|---|
| EP | WO 84/01800 | 10/1984 |

* cited by examiner

*Primary Examiner*—Thomas Denion
*Assistant Examiner*—Theresa Trieu
(74) *Attorney, Agent, or Firm*—Christopher H. Hunter

(57) ABSTRACT

A hydraulic device includes a housing enclosing a hydraulic motor having a wobble shaft driven by a rotor of a gerotor gear set. An outer end of the wobble shaft is connected to the inner end portion of an output shaft. The output shaft extends axially through the housing and outward from the end of the housing opposite from the motor. A brake assembly holds the motor output shaft against rotation when the hydraulic motor is not operated. The brake assembly includes a series of compression springs provided toward the motor end of the housing, brake disks provided toward the end of the housing opposite from the motor, and an annular piston disposed axially between the springs and the brake disks. The piston and housing include corresponding radial stop surfaces that engage across a major portion of the stop surfaces to prevent over-compression of the springs and the piston from cocking when the piston engages the housing. The housing includes a unitary cup-shaped end cover and unitary housing body which together sealingly enclose the brake disks, annular piston and compression springs therebetween. An axial thrust bearing is provided in the motor pressure zone to axially support the output shaft.

20 Claims, 4 Drawing Sheets

HYDRAULIC MOTOR WITH BRAKE ASSEMBLY

The present application claims the benefit of the filing date of U.S. Provisional Application Ser. No. 60/134,986; filed May 20, 1999.

BACKGROUND OF THE INVENTION

The present invention relates to a device that includes a hydraulic motor which is operable to drive an output shaft, and a brake assembly which is engageable to hold the output shaft against rotation when the motor is in an inactive condition.

A known hydraulic device having a motor which drives an output shaft and a brake assembly which holds the output shaft against rotation when the motor is in an inactive condition is described in U.S. Pat. No. 3,960,470, entitled "Hydraulic Motor Brake". This known hydraulic device includes a motor of the gerotor gear type. During operation of the motor, a rotor orbits and rotates relative to a stator. A portion of a wobble or drive shaft is connected with the rotor for orbital and rotational movement with the rotor. An outer end portion of the drive shaft is telescopically received in a hollow inner end portion of an output shaft. During operation of the motor, the drive shaft rotates the output shaft.

The hydraulic device of the aforementioned U.S. Pat. No. 3,960,470 includes a brake assembly which is connected to a portion of the drive or wobble shaft and is disposed on a side of the motor opposite from the output shaft. The brake assembly includes movable disks which rotate and orbit with the drive shaft during operation of the hydraulic motor and stationary disks which are interleaved with the movable disks. When the motor is in an inactive condition, the movable and stationary brake disks are pressed together to hold the drive shaft and, therefore, the output shaft against rotation. When the motor is to be operated, the brake assembly is released to enable the drive shaft to rotate and orbit. The housing for this devices includes a long cylindrical casing that encloses a complex arrangement of components for the motor and brake assembly of this construction.

A similar hydraulic device is described in U.S. Pat. No. 4,981,423, entitled "Hydraulic Motor With Wobble-Stick And Brake Assembly". In this device, the outer end of the drive shaft is also received in a hollow end portion of the output shaft. A fluid flow passage is provided through the hollow end portion of the output shaft to the motor. A seal engages the outer surface on the hollow end portion of the output shaft to block hydraulic fluid flow between the motor and the brake assembly while allowing hydraulic fluid flow through the passage during operation of the motor. The housing for the device includes three separate components, a cup-shaped body portion, a cup-shaped intermediate portion and a cover portion to contain the brake disks, compression springs and piston of the brake assembly.

While the above hydraulic devices have certain advantages, it is believed that there is a demand for a hydraulic device which is even easier to manufacture and assemble than the know hydraulic devices, is more compact, provides less chance of leakage, and has consistent, reliable operation even at high pressures. High pressure operation can sometimes cause internal components to cock or bind during operation, which is undesirable in many circumstances.

SUMMARY OF THE PRESENT INVENTION

The present invention provides a hydraulic device that is easy to manufacture and assemble, is compact, minimizes the chance of leakage, and has consistent, reliable operation even at high pressures.

According to the present invention, the hydraulic device includes a housing enclosing a hydraulic motor and a brake assembly. The motor is located at one (rear) end of the housing and includes a stator and a rotor having cooperating teeth which define fluid pockets. The rotor rotates and orbits relative to the stator when hydraulic fluid is directed to the pockets. An inner end portion of a wobble or drive shaft is connected with the rotor for rotational and orbital movement with the rotor relative to the stator. An outer end portion of the wobble shaft is received in a hollow inner end portion of a rotatable output shaft. The output shaft extends axially through the housing and outwardly from the other end of the housing, and rotates upon rotation and orbital movement of the rotor.

The brake assembly is connected with the output shaft at the other (front) end of the housing opposite from the motor. Prior to initiation of operation of the motor, the brake assembly holds the output shaft against rotation. Upon initiation of operation of the motor, the brake assembly is operated to a disengaged condition to allow the output shaft to be freely rotated by the hydraulic motor.

The brake assembly includes a plurality of brake disks interleaved in face-to-face relation with one another, with at least some of the disks being fixed to the output shaft for rotation therewith, and other of the brake disks being fixed to the housing. An annular actuator piston surrounds the output shaft and is axially moveable with respect thereto. A series of compression springs are normally biased against a rear annular surface of the piston to urge the piston forwardly against the brake disks to cause the brake disks to brake the output shaft. An annular fluid pressure cavity defined by a front surface of the piston, axially-opposite from the rear surface, moves the piston rearwardly away from the brake disks when fluid above the force of the spring enters the cavity. The springs are provided toward the motor (rear) end of the housing, the brake disks are provided at the opposite (front) end of the housing, and the piston is disposed axially between the springs and the brake disks.

The actuator piston for the brake assembly includes an annular, radially-extending, preferably flat stop surface at the rear end of the piston. The housing includes a corresponding annular, radially-extending, preferably flat stop surface in opposing relation to the piston stop surface. The stop surface of the piston engages the stop surface of the housing along at least the inner and outer diameters of the piston prior to maximum compression of the spring. The piston is prevented from cocking or binding at the end of its stroke, and possibly causing seizure or fatigue failure of the piston, particularly during high-pressure operation.

The housing for the hydraulic device includes a unitary, one-piece housing cover at the forward end of the housing having a central opening for the output shaft. The housing cover has a cup-shape and receives and at least partially encloses the brake disks and the annular piston to allow pre-assembly of these components. The housing further includes a unitary, one-piece housing body having a series of axially-extending cylindrical cavities to receive the compression springs. The cup-shaped end cover and housing body sealingly enclose the brake disks, annular piston and compression springs therebetween. The two-piece housing (cover and body) provides a compact hydraulic device that is easy to manufacture and assemble.

A thrust bearing is disposed adjacent the inner end of the output shaft in the motor pressure zone. The thrust bearing at least partially axially supports the inner end portion of said output shaft for rotation relative to the housing, and is continuously lubricated by the fluid supplied to the motor. An annular seal is provided between the thrust bearing and the brake assembly to block fluid flow between the hydraulic motor and the brake assembly.

Further features of the present invention will become apparent to those skilled in the art upon reviewing the following specification and attached drawings.

DETAILED DESCRIPTION OF THE PREFERRED EMBODIMENT

Figure 1:
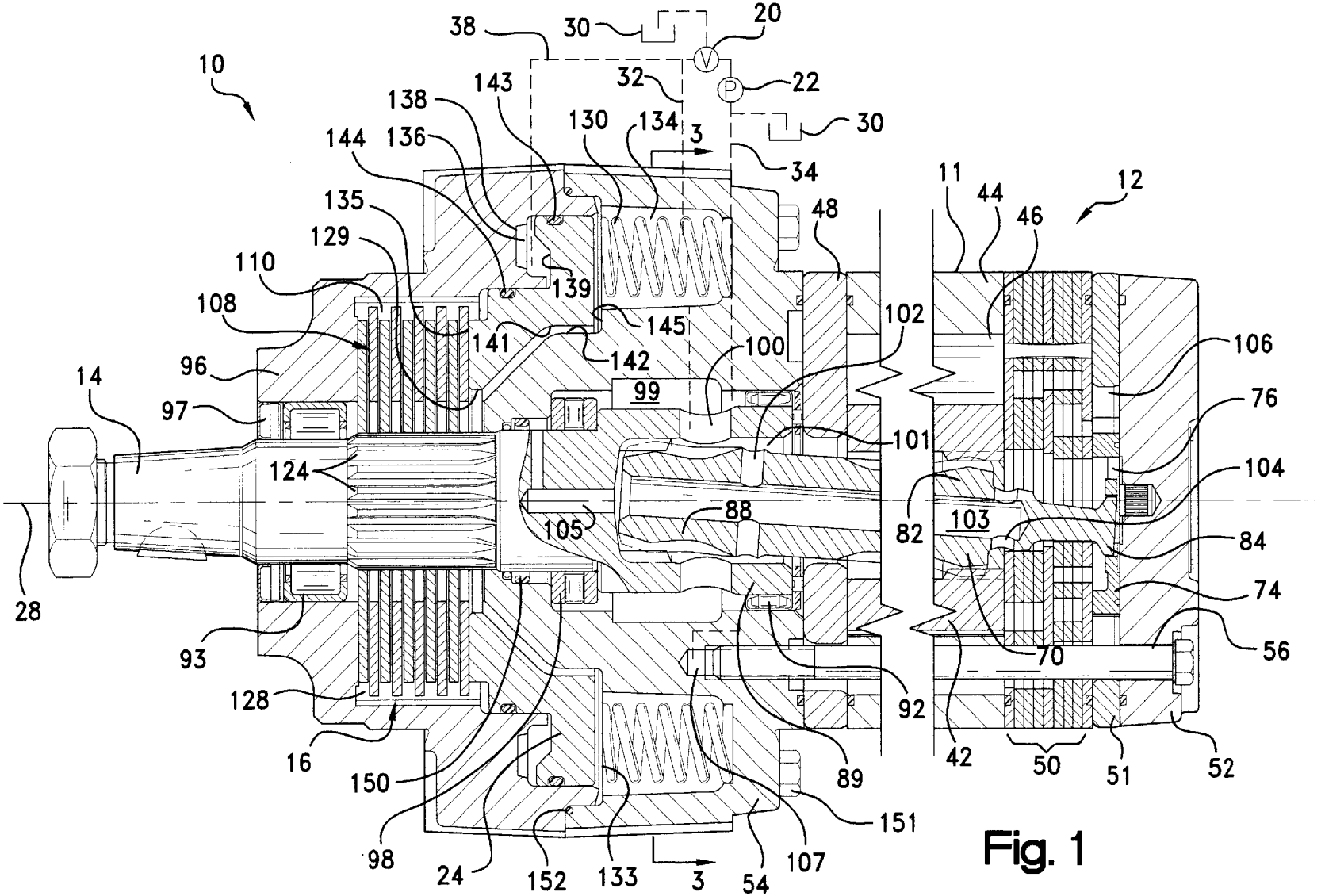
FIG. 1 is a sectional view of a hydraulic device constructed according to the principles of the present invention.

Referring initially to FIG. 1, a hydraulic device constructed according to the principles of the present invention is indicated generally at 10. The hydraulic device 10 includes an axially-extending housing 11 enclosing a hydraulic motor, indicated generally at 12, at one end of the housing. The hydraulic motor has a rotatable output shaft 14, which extends axially through and outwardly from the other end of the housing. A brake assembly, indicated generally at 16, holds the output shaft 14 against rotation when the hydraulic motor 12 is not being operated. Brake assembly 16 is located at an end of the housing opposite from the motor 12. Although the hydraulic device 10 can be used in many different environments to provide the driving force for many different known types of devices, the hydraulic device 10 is particularly useful for driving vehicle wheels, lifts, winches, rollers, vibrators, and conveyors.

When the hydraulic motor 12 is to be operated, a valve 20 is actuated to connect hydraulic fluid pressure from a pump 22 with both the hydraulic motor 12 and the brake assembly 16. As the hydraulic pressure transmitted from the valve 20 to the brake assembly 16 increases, an actuator piston 24 in the brake assembly operates the brake assembly to a disengaged condition. Thereafter; as the fluid pressure conducted from the valve 20 continues to increase, the hydraulic motor 12 begins to operate. Operation of the hydraulic motor 12 results in the output shaft 14 being rotated about its central axis 28.

When the hydraulic motor 12 is to be stopped, the valve 20 is again actuated. This results in both the hydraulic motor 12 and the brake assembly 16 being connected with low pressure, that is with drain or reservoir 30. As the hydraulic fluid pressure decreases, the motor 12 slows down. As the hydraulic pressure decreases still further, the brake assembly 16 is actuated to hold the output shaft 14 against rotation.

During operation of the hydraulic motor 12, there is a continuous flow of hydraulic fluid from the valve 20 through the conduit 32 into the motor to supply working fluid to the motor. There is also a continuous flow of fluid outwardly from the hydraulic motor 12 through a conduit 34 to drain or reservoir 30. Although there is a continuous flow of fluid through the hydraulic motor 12 during operation of the motor, there is a relatively static body of hydraulic fluid in the brake assembly 16. When the valve 20 is operated, hydraulic fluid pressure is transmitted through a conduit 38 to operate the actuator 24.

The hydraulic motor 12 is of the known gerotor gear type and includes an externally toothed rotor 42 which cooperates with an internally toothed stator 44 to define a plurality of fluid pockets 46. The rotor 42 is circumscribed by the stator 44. The left (as viewed in FIG. 1) end of the rotor 42 slidably engages a wear plate 48. The opposite (right) end of the rotor 42 slidably engages one of a plurality of stationary valve or manifold plates 50 which are brazed together. On the side of the manifold plates 50 opposite the rotor 42 are a thick annular plate 51 and then an end cap 52. Bolts 56 extend through the end cap 52, the plate 51, the manifold plates 50, stator 44 and wear plate 48 to secure all of these components to the housing body 54 of the brake assembly 16.

An inner end portion 82 of a drive or wobble shaft 70 is connected with the rotor 42 for orbital and rotational movement with the rotor. The end portion 82 of the drive shaft 70 has external splines which mesh with internal splines on the rotor 42. The splined connection between the end portion 82 of the drive shaft 70 and rotor 42 allows the end portion of the drive shaft to rock or pivot relative to the rotor during orbital and rotational movement of the rotor.

The nose or tip 84 of the inner end portion of the drive shaft 70 is received in a circular opening in a commutator valve 74 encircled by the plate 51. The nose 84 of the drive shaft 70 moves the commutator valve 74 along a circular path in synchronism with orbital movement of the rotor 42.

A forward or left (as viewed in FIG. 1) end portion 88 of the drive shaft 70 is telescopically received in a hollow rear end portion 89 of the output shaft 14. External splines on the end portion 88 of the drive shaft mesh with internal splines on the hollow end portion 89 of the output shaft 14. The splined connection between the drive shaft 70 and output shaft 14 allow the end portion 88 of the drive shaft to rock or pivot relative to the hollow end portion 89 of the output shaft 14.

The output shaft 14 is supported for rotation about its longitudinal central axis 28. The hollow end portion 89 of the output shaft 14 is supported by an annular radial bearing assembly 92. The radial inner bearing assembly 92 is connected with the housing body 54. The inner bearing assembly 92 has a plurality of roller-type bearing elements which engage a radially outer circumferential surface on the hollow end portion 89 of the output shaft 14.

A forward annular radial bearing assembly 93 is disposed between the output shaft 14 and the housing cover 96 to support the outer end portion of the output shaft. A dirt and water seal 97 is provided axially outwardly of the radial bearing assembly 93. A thrust bearing assembly 98 is disposed between radially extending and opposing surfaces on the shaft 14 and the housing body 54, and includes a plurality of roller-type bearing elements between a pair of thrust washers. The thrust bearing assembly 98 transmits axially-directed forces from the output shaft 14 to the housing body 54, and facilitates rotation of the shaft 14. The outer end of the output shaft 14 is adapted to be connected with a member to be driven by the hydraulic motor 12.

Figure 3:
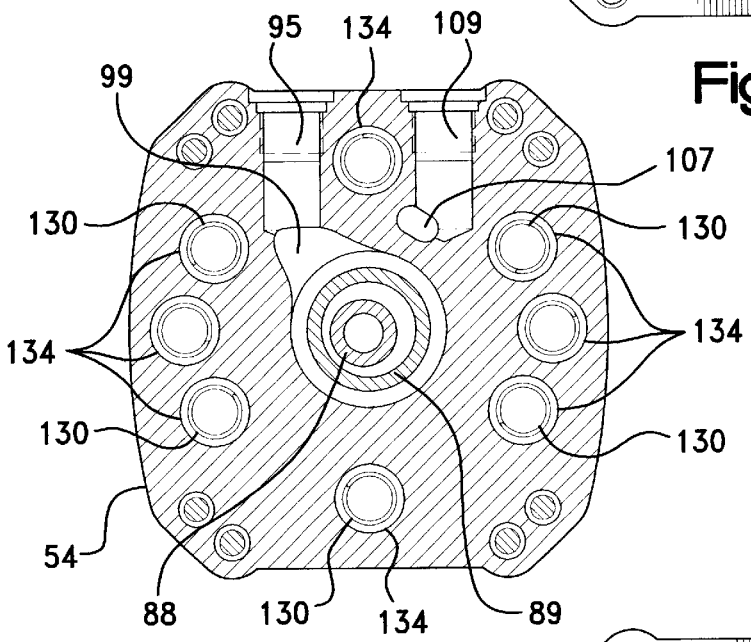
FIG. 3 is a cross-sectional end view of the hydraulic device taken substantially along the plane described by the lines 3—3 of FIG. 2.

During operation of the hydraulic motor 12, high-pressure hydraulic fluid flows from the pump 22 through the valve 20 and conduit 32 through an inlet passage 95 in body 54 (see FIG. 3) into an annular inlet cavity 99. The inlet cavity is located between the inner and outer radial bearing assemblies 92 and 93 and is defined, in part, by the outer circumferential surface of the hollow inner end portion of the output shaft 14 and the housing body 54. The hydraulic fluid flows from the cavity 99 through a plurality of passages 100 in the inner end portion 89 of the output shaft 14 into a cavity 101 formed in the hollow inner end portion. The hydraulic fluid then flows through radial passage 102 in drive shaft 70, axially along a central channel 103, and then radially-outward through passages 104 to the manifold plates 50. Fluid may also pass axially along the outside of the drive or wobble shaft and through the rotor 42 to the manifold plates 50.

Fluid may also pass in a reverse direction through passage 103 and through the outer end portion 88 of the drive shaft to a vent passage 105 in output shaft 14 to provide fluid forwardly of the thrust bearing 98 for lubrication purposes. Thrust bearing 98 is thereby constantly immersed in lubricating fluid in the pressure zone of the motor.

The commutator valve 74 cooperates with the manifold plates 50 to direct high pressure hydraulic fluid from a cavity 76 inside the circular commutator valve to expanding fluid pockets 46 formed between the rotor 42 and stator 44. At the same time, hydraulic fluid is directed from contracting fluid pockets 46 through the stationary manifold plates 50 to an annular chamber 106 defined between the annular plate 51 and the commutator valve 74 and which circumscribes the commutator valve. The chamber 106 is connected with a passage 107 surrounding bolts 56, which directs the fluid along the bolts to an outer passage 109 (FIG. 3) in body 54, and then to drain or reservoir 30 through conduit 34 formed in body 54.

As the fluid pockets 46 sequentially expand and contract, the rotor 42 rotates about its own central axis and orbits about the central axis of the stator 44 in a known manner. Rotation of the rotor rotates the drive shaft 70, which, in turn, rotates the output shaft 14. The manner in which the rotor 42 cooperates with the stator 44 to define fluid pockets, the manner in which the commutator valve 74 directs hydraulic fluid to expanding pockets and from contracting pockets, and the manner in which the rotor 42 drives the wobble shaft 70 and output shaft 14 are the same as is disclosed in U.S. Pat. No. 3,601,513, which is incorporated herein by reference. The foregoing discussion of the motor 12 and associated components is described in U.S. Pat. No. 4,981,423, which is also incorporated herein by reference.

The hydraulic brake assembly 16 includes an annular brake pad assembly or disk pack, indicated generally at 108, and the actuator piston 24, which actuates the disk pack. The disk pack 108 is disposed in an annular cavity 110 formed in the housing cover 96 around the output shaft 14. The piston 24 is also received in the cover 96, and at least partially surrounded thereby.

Figure 7:
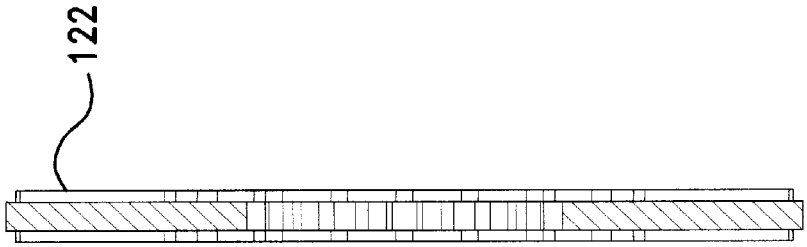
FIG. 7 is a cross-sectional end view of the brake pad taken substantially along the plane described by the lines 7—7 of FIG. 6.
Figure 6:
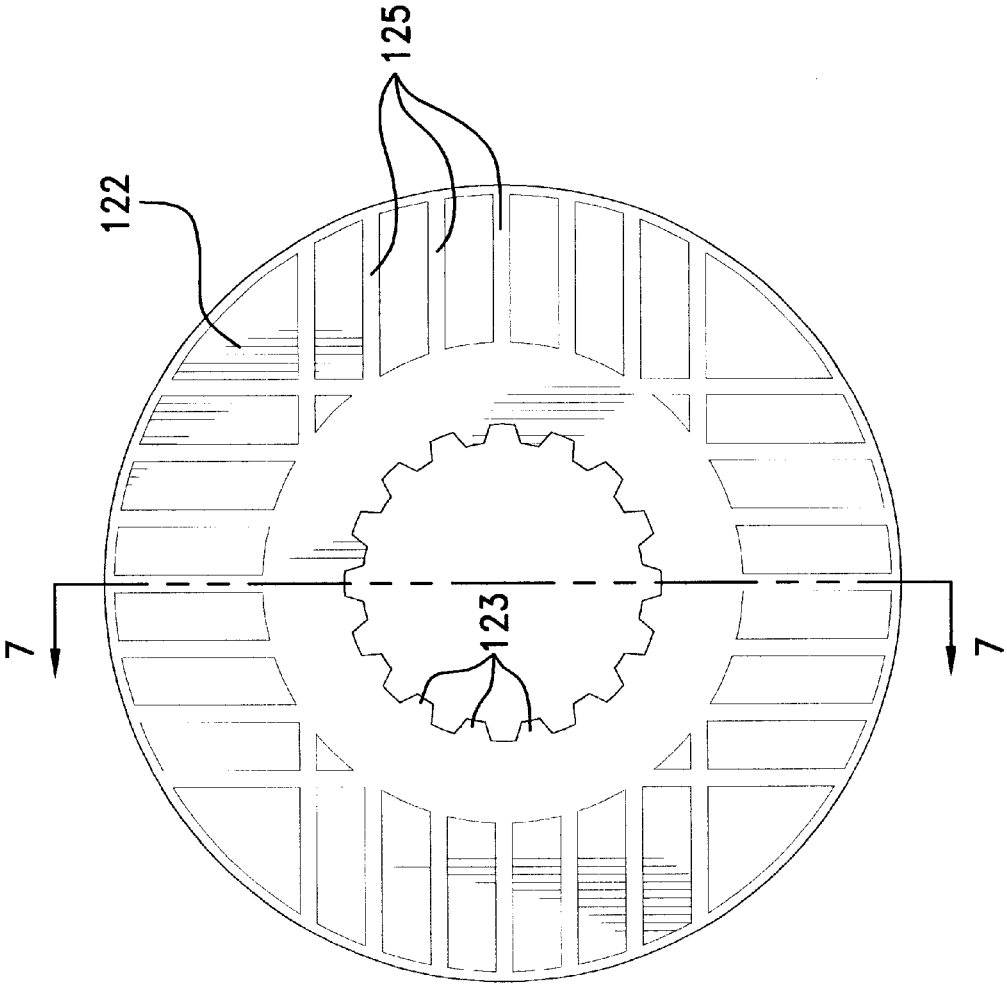
FIG. 6 is a front plan view of a brake friction pad for the brake assembly of the hydraulic device.

The disk pack 108 includes a plurality of annular inner brake disks or friction plates 122 (see FIGS. 6, 7). Each of the annular inner brake disks 122 has internal splines as at 123 on its radially inner circumferential surface which engage external splines as at 124 on the radially outer circumferential surface of the output shaft 14 at a location between the inner and outer radial bearings 92 and 93 (FIG. 1). The splines 123 on the inner brake disks 122 and output shaft 14 interconnect the inner brake disks and output shaft for rotation together relative to the housing cover 96. The inner brake disks 122 each have a grid or matrix of shallow grooves as at 125 on the side surfaces which dissipate oil to facilitate the braking action of the brake assembly.

Figure 9:
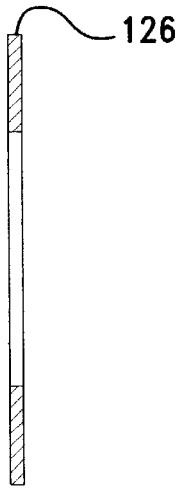
FIG. 9 is a cross-sectional end view of the brake pad taken substantially along the plane described by the lines 9—9 of FIG. 8.
Figure 8:
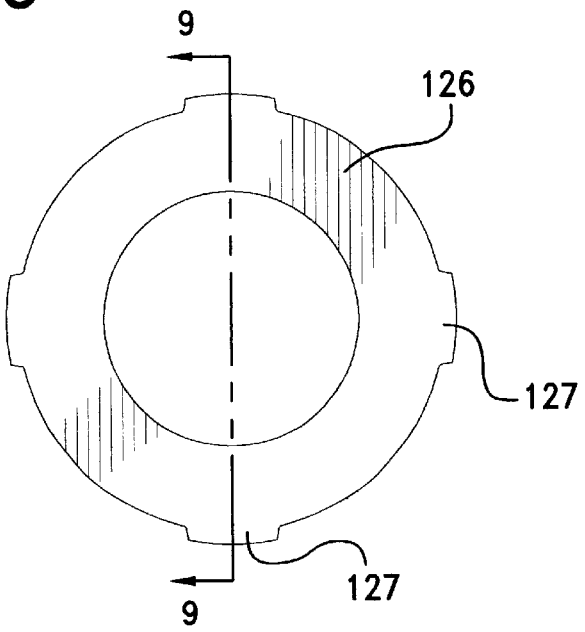
FIG. 8 is a front plan view of a brake separator pad for the brake assembly of the hydraulic device.

A plurality of annular outer brake disks or separator plates 126 (FIGS. 8, 9) are interleaved in face-to-face relation with the annular inner brake disks 122. Each of the outer brake disks 126 has external splines 127 on its radially outer circumferential surface which engage internal splines 128 (See also FIG. 2) on an internal circumferential surface of the housing body 96 to hold the outer brake disks against rotation relative to the housing. Lubricating oil (at atmospheric pressure) is typically introduced into cavity 110 for lubrication of the disk pads. The lubricating oil also lubricates the front bearing 93 and enters cavities 134 containing springs 130 through the space between piston 24 and body 54.

Figure 4:
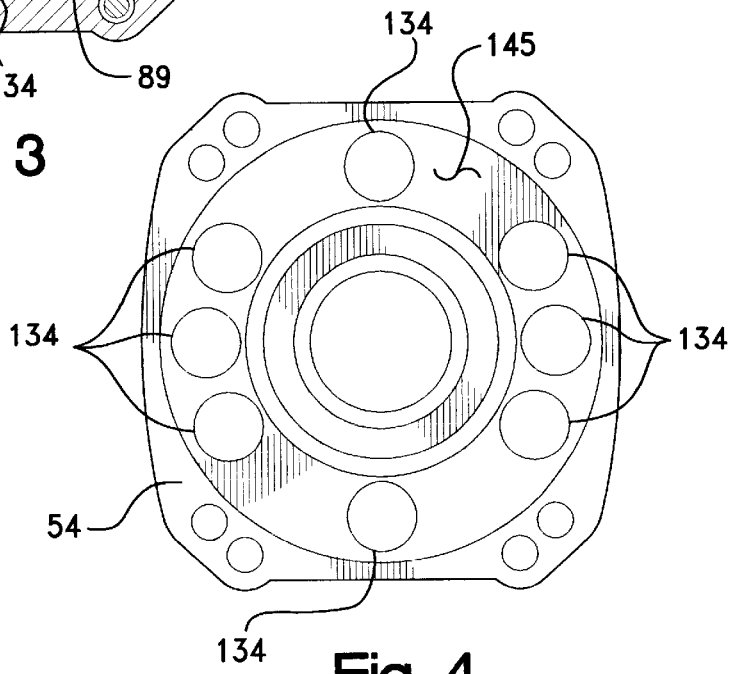
FIG. 4 is a front plan view of the housing body of the hydraulic device.
Figure 5:
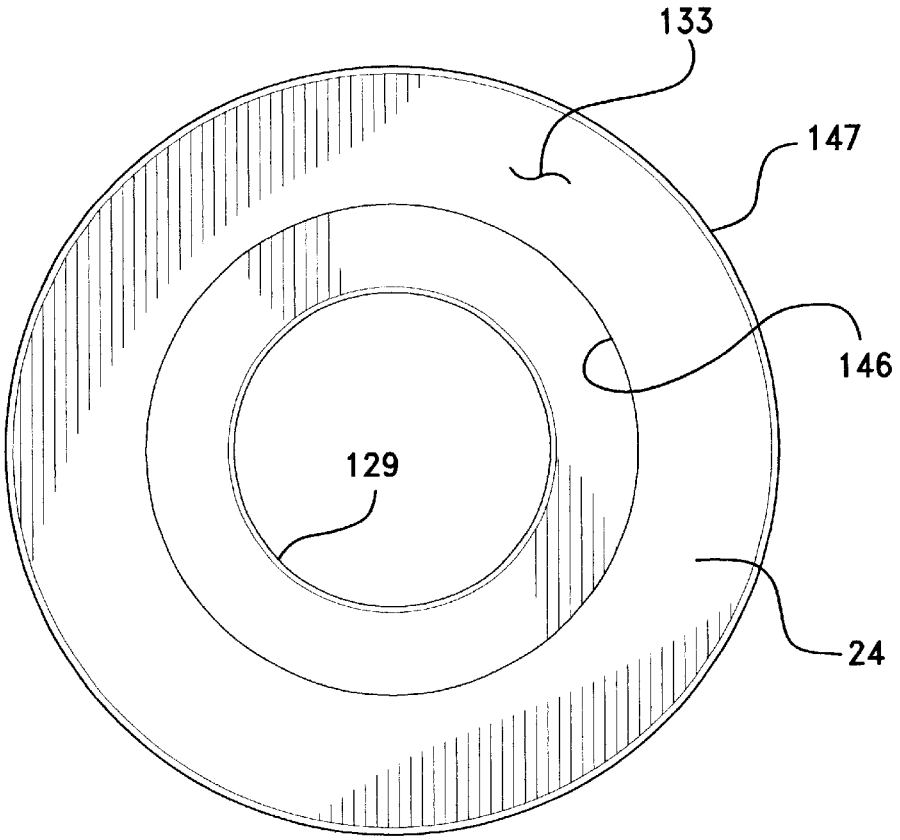
FIG. 5 is a rear plan view of the piston for the hydraulic device.

The actuator piston 24 has an annular configuration with a circular central opening 129 through which the output shaft 14 extends (See also FIG. 5). The piston 24 is pressed toward the left (as viewed in FIG. 1) by a plurality of compression springs 130. Springs 130 act against a flat, annular, radially-extending rear surface 133 of piston 24. Springs 130 are disposed within respective axially-extending, cylindrical spring cavities 134 (FIGS. 3, 4) formed in the housing body 54. Cavities 134 are formed in spaced arrangement around the body for the even distribution of the force against piston 24, with the cavities opening toward the brake assembly end of the housing (the left in FIG. 1), that is, away from the motor portion of the housing. The force exerted by the springs 130 against the piston 24 is transmitted by the front, flat, annular end 135 on the left end (as viewed in FIG. 1) of the piston 24 to the first brake disk, which as illustrated is an outer brake disk 126 of the brake disk pack 108. The first brake disk is pressed against the remaining disks in the disk pack 108 to clamp the disk pack between the annular brake disk pad and the housing cover 96. The clamping force applied against the disk pack 108 by the piston 24 presses the flat side surfaces of the inner and outer brake disks 122 and 126 firmly together so that friction forces between the brake disks hold the output shaft 14 against rotation.

An annular fluid pressure cavity 136 is provided between cover 96 and piston 24. The cavity 136 is defined on one side by annular channel 138 in cover 96 (see also FIG. 2), and on the other side, by a front surface 139 of the actuating piston 24, which is opposite from the rear surface 133 upon which spring 130 acts. Cavity 136 is connected through an inlet passage 140 to the pump 22 through the valve 20 and the conduit 38. Hydraulic pressure introduced into the cavity 136 will act in opposition to the springs 130 to release the disk pack. Piston 24 has a radially-inner surface 141 which closely surrounds a radially-outer surface 142 on body 54., and allows hydraulic fluid to pass from cavity 136 to brake disk cavity 110

A pair of annular seals 143 and 144 (FIG. 1) are provided between the actuator piston 24 and the housing cover 96. The seals 143 and 144 block the leakage of hydraulic fluid from the cavity 136. Since hydraulic fluid cannot leak out of the cavity 136 and since the volume of the cavity increases by a relatively small amount when the piston 24 is moved to release the disk pack 108, there is a very small volume of fluid flow into the cavity. This tends to minimize the amount of contaminants to which the brake assembly 16 is exposed.

When hydraulic fluid pressure is conducted from the valve 20 to the annular fluid pressure cavity 136, the piston 24 is moved rearwardly toward the right (as viewed in FIG. 1) against the force of the springs 130. As the fluid pressure overcomes the spring force and the piston 24 moves rightward, the clamping force applied against the disk pack 108 is released. The piston can move rightward until the annular surface 133 on the inner end of the piston engages the opposing annular surface 145 surrounding the cavities 134 (see also FIG. 4). The stop surface 133 on the piston and the stop surface 145 on the housing body 54 come into contact across preferably the entire radial extent of the inner piston end, from the inner diameter 146 of the piston surface 133 to the outer diameter 147 (FIG. 5), although at least it is preferred that the piston engage the housing body along with the inner and the outer diameter of the piston stop surface. In any case, the piston contacts the body housing prior to the compression springs 130 reaching maximum compression. This assures that the piston will not cock or bind, or have seizure or fatigue failure during high-pressure operation, which might happen, for example, if the piston were only supported at its outer or inner diameter. The smooth operation of the piston also reduces wear on seals 143, 144.

While it may appear in FIG. 1 that the piston 24 does not contact surface 145 at its radially outer edge, it will be easily understood by reviewing FIG. 4 that the piston will engage the radial surface 145 at the areas bounding the cylindrical cavities 134, which includes an annular surface area outwardly of all the cavities, an annular surface area inwardly of all of the cavities, as well as the areas between the cavities. Operation of a hydraulic device constructed according to the present invention has been successful at pressures of up to 3000 psi. It is believed that prior hydraulic devices have not been able to withstand pressures of this magnitude, and generally operate in the 1000 psi range, which is easier for the components of the device to tolerate.

When the clamping force against the disk pack 108 is released, the inner brake disks 122 are free to rotate with the output shaft 14 relative to the outer brake disks 126 and housing 54. Again, the chamber 110 is filled with lubricating fluid that tends to minimize friction between the inner and outer disks 122 and 126 when the disk pack 108 is in a disengaged condition.

When the disk pack 108 is in the release or disengaged condition, the output shaft 14 is free to rotate relative to the housing 54. When the valve assembly 20 is operated to connect the actuator assembly 24 and hydraulic motor 12 with drain 30, the coil springs 130 press the piston 118 toward the left (as viewed in FIG. 1) to operate the disk pack 108 to an engaged condition. Again, when the disk pack 108 is in an engaged condition, the output shaft 14 is held against rotation relative to the housing 54.

A high pressure shaft seal 150 (FIG. 1) separates the hydraulic fluid pressure in the motor 12 from the brake assembly 16. The annular seal 150 circumscribes the hollow inner end portion 89 of the output shaft 14 and the outer end portion 88 of the drive or wobble shaft 70. The seal 150 is located between the inner and outer radial bearings 92 and 93 so that there is minimal deflection of the output shaft 14 where it engages the seal 150. Seal 150 is also located axially between the thrust bearing 98 and the brake disk pack 108, so that the thrust seal is in the pressure zone of the motor, rather than in the pressure zone of the brake assembly. During rotation of the output shaft 14, the high pressure seal 150 remains stationary in the housing 54. Further discussion of the seal 150 can be found in U.S. Pat. No. 4,981,423.

Figure 2:
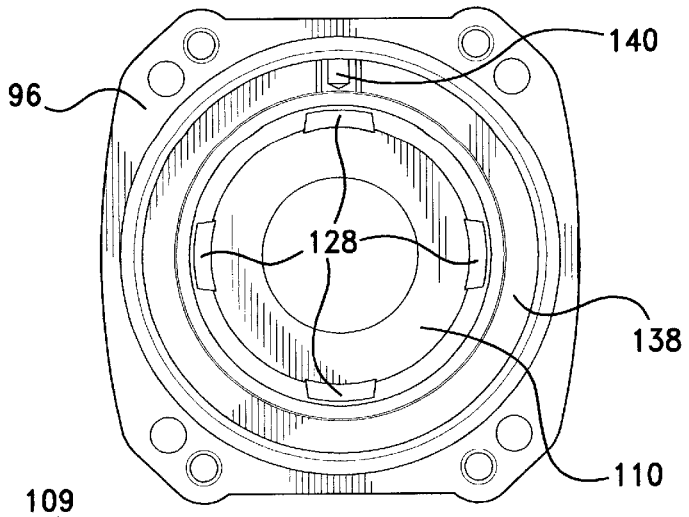
FIG. 2 is a rear plan view of the housing cover for the hydraulic device of FIG. 1.

The seal 150 engages the hollow inner end portion 66 of the output shaft 14 at a location that is axially forward, that is toward the left, as viewed in FIGS. 1 and 2, of inner bearing assembly 92 and the radial passages 100 which extend between the inlet cavity 99 and the cavity 101 on the inside of hollow end portion 89 of the output shaft 14. This enables the seal 150 to block outward or leftward (as viewed in FIG. 2) flow of high pressure hydraulic fluid from the inlet cavity 99 along the output shaft 14 toward the disk pack cavity 110 in the brake assembly 16.

The seal 150 blocks fluid flow between the hydraulic motor 12 (FIG. 1) and the brake assembly 16 while allowing fluid to flow from the inlet cavity 99 to the hydraulic motor and to lubricate thrust bearing 98. Hydraulic fluid conducted from the conduit 32 can flow through the inlet cavity 99 into the cavity 100 on the inside of the hollow inner end portion 89 of the output shaft 14, and thereby also through passage 102 and conduit 103 to manifold plates 50.

Housing cover 96 and housing body 54 are each formed unitarily in one piece. Cover 96 has a cup-shaped configuration, which receives brake disks of pack 108 and piston 24 when assembled. Piston 24 and disk pack 108 can be pre-assembled into cover 96 to facilitate the assembly of the entire hydraulic device. Cover 96 is then secured to body 54 with bolts 151, which encloses disk pack 108, piston 24 and springs 130 therebetween. An annular elastomeric seal 152 is provided between the cover 96 and body 54 to ensure a fluid-tight seal between these components. The arrangement of the brake disk pack 108, piston 24 and springs 130 makes the hydraulic device particularly easy to assemble, with the disk pack toward the left (as in FIG. 1) end of the brake assembly housing, the springs toward the right end of the brake assembly housing (adjacent the motor), and the piston located axially between the disk pack and the springs. The piston 24 fits closely around an inner cylindrical portion of the housing body 54 to reduce the over-all length of the hydraulic device.

Thus, as described above, the present invention provides a hydraulic device that is easy to manufacture and assemble, is compact, minimizes the chance of leakage between components, and has consistent, reliable operation, particularly at high pressures.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A hydraulic device, comprising:

an axially-extending housing;

a hydraulic motor at one end of the housing having a stator and a rotor with cooperating teeth defining fluid pockets, a wobble shaft connected to said rotor, said rotor rotating and orbiting relative to said stator when hydraulic fluid is directed into and out of the fluid pockets;

an axially-extending output shaft extending outward from another end of the housing, the output shaft having an inner end portion located in the housing and connected to said wobble shaft to rotate said output shaft upon rotation and orbital movement of said rotor;

a brake assembly axially disposed between the one end and the other end of the housing including i) a plurality of annular brake disks interleaved in face-to-face relation with one another, at least some of said disks being fixed to the output shaft for rotation therewith, and other of said brake disks being fixed to the housing; ii) an annular piston surrounding the output shaft and axially moveable with respect thereto; and iii) at least one spring device normally biased against one annular surface of the piston to urge said piston toward and against the brake disks to cause said brake disks to brake the output shaft; an annular fluid pressure cavity defined by another surface of the piston axially-opposite from the one surface to move the piston away from the brake disks when fluid above the force of the spring device enters the cavity, said piston including a radially-projecting stop surface across a major portion of the one surface of the piston and the housing including a corresponding radially-projecting stop surface, the stop surface of the piston engaging the stop surface of the housing at least along the inner diameter of the annular one surface of the piston prior to maximum compression of the spring device, wherein the piston is prevented from cocking when the stop surface of the piston contacts the stop surface of the housing.

2. The hydraulic device as in claim 1, wherein the stop surface of the piston is also along at least the outer diameter of the one annular surface of the piston.

3. The hydraulic device as in claim 1, wherein a plurality of springs are provided normally under compression against the one annular surface of the piston to urge said piston toward and against the brake disks, the springs located in a series of cylindrical cavities formed in the housing, with the housing stop surface radially inwardly and outwardly bounding the cavities.

4. The hydraulic device as in claim 3, wherein the cylindrical cavities for the compression springs open toward the other end of the housing, away from the motor end of the housing.

5. The hydraulic device as in claim 1, wherein the spring device is provided toward the motor end of the housing, the brake disks are provided toward the other end of the housing, and the piston is disposed axially between the spring device and the brake disks.

6. A hydraulic device, comprising:

an axially-extending housing;

a hydraulic motor at one end of the housing having a stator and a rotor with cooperating teeth defining fluid pockets, a wobble shaft connected to said rotor, said rotor rotating and orbiting relative to said stator when hydraulic fluid is directed into and out of the fluid pockets;

an axially-extending output shaft extending outward from another end of the housing, the output shaft having an inner end portion located in the housing and connected to said wobble shaft to rotate said output shaft upon rotation and orbital movement of said rotor;

a brake assembly axially disposed between the one end and the other end of the housing including i) a plurality of annular brake disks interleaved in face-to-face relation with one another, at least some of said disks being fixed to the output shaft for rotation therewith, and other of said brake disks being fixed to the housing; ii) an annular piston surrounding the output shaft and axially moveable with respect thereto; and iii) a series of compression springs normally biased against one annular surface of the piston to urge said piston toward and against the brake disks to cause said brake disks to brake the output shaft; an annular fluid pressure cavity defined by another surface of the piston axially-opposite from the one surface to move the piston away from the brake disks when fluid above the force of the springs enters the cavity;

said housing including a) a unitary, one-piece housing cover at the other end of the housing having a central opening for the output shaft, said housing cover having a cup-shape and receiving and at least partially enclosing the brake disks and the annular piston, and b) a unitary, one-piece housing body toward the one end of the housing having a series of axially-extending cylindrical cavities to receive the compression springs, the cup-shaped housing cover and housing body sealingly enclosing the brake disks, annular piston and compression springs therebetween.

7. The hydraulic device as in claim 6, wherein the cylindrical cavities for the compression springs open toward the other end of the housing, away from the motor end of the housing.

8. The hydraulic device as in claim 7, wherein the housing body is located adjacent the hydraulic motor, and the housing cover is located spaced-apart from the hydraulic motor.

9. The hydraulic device as in claim 6, wherein the compression springs are provided toward the motor end of the housing, the brake disks are provided toward the other end of the housing, and the piston is disposed axially between the springs and the brake disks.

10. A hydraulic device, comprising:

an axially-extending housing;

a hydraulic motor at one end of the housing having a stator and a rotor with cooperating teeth defining fluid pockets, a wobble shaft connected to said rotor, said rotor rotating and orbiting relative to said stator when hydraulic fluid is directed into and out of the fluid pockets;

an axially-extending output shaft extending outward from another end of the housing, the output shaft having an inner end portion located in the housing and connected to said wobble shaft to rotate said output shaft upon rotation and orbital movement of said rotor;

a brake assembly axially disposed between the one end and the other end of the housing including i) a plurality of annular brake disks interleaved in face-to-face relation with one another, at least some of said disks being fixed to the output shaft for rotation therewith, and other of said brake disks being fixed to the housing; ii) an annular piston surrounding the output shaft and axially moveable with respect thereto; and iii) at least one spring device normally biased against one annular surface of the piston to urge said piston toward and against the brake disks to cause said brake disks to brake the output shaft; an annular fluid pressure cavity defined by another surface of the piston axially-opposite from the one surface to move the piston away from the brake disks when fluid above the force of the spring device enters the cavity, the spring device provided toward the one end of the housing, the brake disks provided toward the other end of the housing, and the piston disposed axially between the spring device and the brake disks.

11. The hydraulic device as in claim 10, wherein a plurality of springs are provided normally under compression against the one annular surface of the piston to urge said piston toward and against the brake disks, the springs being located in a series of cylindrical cavities formed in the housing, with the housing stop surface radially inwardly and outwardly bounding the cavities.

12. The hydraulic device as in claim 11, wherein the cylindrical cavities for the compression springs open toward the other end of the housing, away from the motor end of the housing.

13. A hydraulic device, comprising:

an axially-extending housing;

a hydraulic motor at one end of the housing having a stator and a rotor with cooperating teeth defining fluid pockets, a wobble shaft connected to said rotor, said rotor rotating and orbiting relative to said stator when hydraulic fluid is directed into and out of the fluid pockets;

an axially-extending output shaft extending outward from another end of the housing, the output shaft having an inner end portion located in the housing and connected to said wobble shaft to rotate said output shaft upon rotation and orbital movement of said rotor;

a brake assembly axially disposed between the one end and the other end of the housing including i) a plurality of annular brake disks interleaved in face-to-face relation with one another, at least some of said disks being fixed to the output shaft for rotation therewith, and other of said brake disks being fixed to the housing; ii) an annular piston surrounding the output shaft and axially moveable with respect thereto; and iii) at least one spring device normally biased against one annular surface of the piston to urge said piston toward and against the brake disks to cause said brake disks to brake the output shaft; an annular fluid pressure cavity defined by another surface of the piston axially-opposite from the one surface to move the piston away from the brake disks when fluid above the force of the spring device enters the cavity;

an annular seal surrounding the output shaft and blocking flow between the brake assembly and the hydraulic motor; and a thrust bearing disposed adjacent the inner end of the output shaft in fluid communication with the hydraulic motor, said thrust bearing disposed between radially-extending and opposing bearing surfaces formed in the housing and in the output shaft, said thrust bearing at least partially axially supporting the inner end portion of said output shaft for rotation relative to the housing.

14. The hydraulic device as in claim 13, wherein the annular seal is disposed axially between the thrust bearing and the brake assembly.

15. The hydraulic device as in claim 13, wherein the thrust bearing is located between the inner end of the output shaft and the brake assembly.

16. The hydraulic device as in claim 13, wherein the thrust bearing is located closer to the inner end of the output shaft, than to an outer end of the output shaft extending outwardly from the housing.

17. A hydraulic device, comprising:

an axially-extending housing;

a hydraulic motor at one end of the housing, and a drive linkage to operate the motor, the drive linkage including an axially-extending output shaft extending outward from another end of the housing, the output shaft rotating upon operation of the motor;

a brake assembly axially disposed between the one end and the other end of the housing including i) a plurality of annular brake disks interleaved in face-to-face relation with one another, at least some of said disks being fixed to the output shaft for rotation therewith, and other of said brake disks being fixed to the housing; ii) an annular piston surrounding the output shaft and axially moveable with respect thereto; and iii) a series of compression springs normally biased against one annular surface of the piston to urge said piston toward and against the brake disks to cause said brake disks to brake the output shaft; an annular fluid pressure cavity defined by another surface of the piston axially-opposite from the one surface to move the piston away from the brake disks when fluid above the force of the springs enters the cavity, said piston including a radially-projecting stop surface across a major portion of the one surface of the piston and the housing including a corresponding radially-projecting stop surface, the stop surface of the piston engaging the stop surface of the housing prior to maximum compression of the springs, wherein the piston is prevented from cocking when the stop surface of the piston contacts the stop surface of the housing, the compression springs provided toward the one end of the housing, the brake disks provided toward the other end of the housing, and the piston disposed axially between the compression springs and the brake disks;

a thrust bearing disposed adjacent the inner end of the output shaft in fluid communication with the hydraulic motor, said thrust bearing disposed between radially-extending and opposing bearing surfaces formed in the housing and in the output shaft, said thrust bearing at least partially axially supporting the inner end portion of said output shaft for rotation relative to the housing;

said housing including a) a unitary, one-piece housing cover at the other end of the housing having a central opening for the output shaft, said housing cover having a cup-shape and receiving and at least partially enclosing the brake disks and the annular piston, and b) a unitary, one-piece housing body toward the one end of the housing having a series of axially-extending cylindrical cavities to receive the compression springs, the cup-shaped housing cover and housing body sealingly enclosing the brake disks, annular piston and compression springs therebetween.

18. The hydraulic device as in claim 17, wherein the stop surface of the piston contacting the stop surface of the housing is at least along the inner diameter of the annular one surface of the piston.

19. The hydraulic device as in claim 18, wherein the stop surface of the piston is also along at least the outer diameter of the one annular surface of the piston.

20. The hydraulic device as in claim 17, wherein the cylindrical cavities for the compression springs open toward the other end of the housing, away from the motor end of the housing.

* * * * *